US006521096B1

(12) United States Patent
Jurvanen

(10) Patent No.: US 6,521,096 B1
(45) Date of Patent: Feb. 18, 2003

(54) SCREEN AND METHOD FOR MANUFACTURING A REINFORCEMENT ELEMENT FOR A SCREEN PLATE

(75) Inventor: Jari Jurvanen, Varkaus (FI)

(73) Assignee: Advanced Fiber Technologies (AFT) Oy, Varkaus (FI)

( * ) Notice: Subject to any disclaimer, the term of this patent is extended or adjusted under 35 U.S.C. 154(b) by 0 days.

(21) Appl. No.: 09/806,672

(22) PCT Filed: Oct. 14, 1998

(86) PCT No.: PCT/FI98/00796

§ 371 (c)(1),
(2), (4) Date: Apr. 3, 2001

(87) PCT Pub. No.: WO00/22228

PCT Pub. Date: Apr. 20, 2000

(51) Int. Cl.[7] ..... B07B 1/18; D21D 5/06

(52) U.S. Cl. ..... 162/380; 162/55; 209/411; 210/402; 210/499; 156/172

(58) Field of Search ..... 162/41, 42, 43, 162/55, 243, 257, 24, 380; 156/162, 164, 171, 172, 173, 175, 184, 187, 432, 443, 450; 8/156; 29/896.62; 210/348, 497.01, 498, 499; 209/288, 303, 324, 350, 361, 409–412; 68/182

(56) References Cited

U.S. PATENT DOCUMENTS

| | | | | | |
|---|---|---|---|---|---|
| 4,130,479 | A | * | 12/1978 | Schiele | 209/395 |
| 4,259,136 | A | * | 3/1981 | Spiewok | 156/293 |
| 4,378,294 | A | * | 3/1983 | Wagner et al. | 210/460 |
| 4,402,830 | A | * | 9/1983 | Pall | 210/457 |
| 5,370,796 | A | | 12/1994 | Grimwood | |
| 5,533,644 | A | * | 7/1996 | Glen et al. | 220/414 |

FOREIGN PATENT DOCUMENTS

| | | | | |
|---|---|---|---|---|
| GB | 1 554 412 | * | 10/1979 | B04B/7/08 |
| GB | 2 077 146 | | 12/1981 | |

* cited by examiner

*Primary Examiner*—Steven P. Griffin
*Assistant Examiner*—Eric Hug
(74) *Attorney, Agent, or Firm*—Nixon & Vanderhye P.C.

(57) ABSTRACT

A screen, such as a drum screen or a flat screen, for screening or fractionizing pulp suspensions or the like suspensions of the pulp and paper industry. The screen comprises a reinforcement attached to the surface of the screen plate, such as a reinforcing ring (16, 18) attached to the surface of a drum screen (10). The reinforcement (17) is made of fiber-reinforced composite material. The invention also relates to a method of manufacturing the reinforcement of a screen plate of composite material. The composite material is preferably made of reinforcing fiber and plastic matrix material.

28 Claims, 2 Drawing Sheets

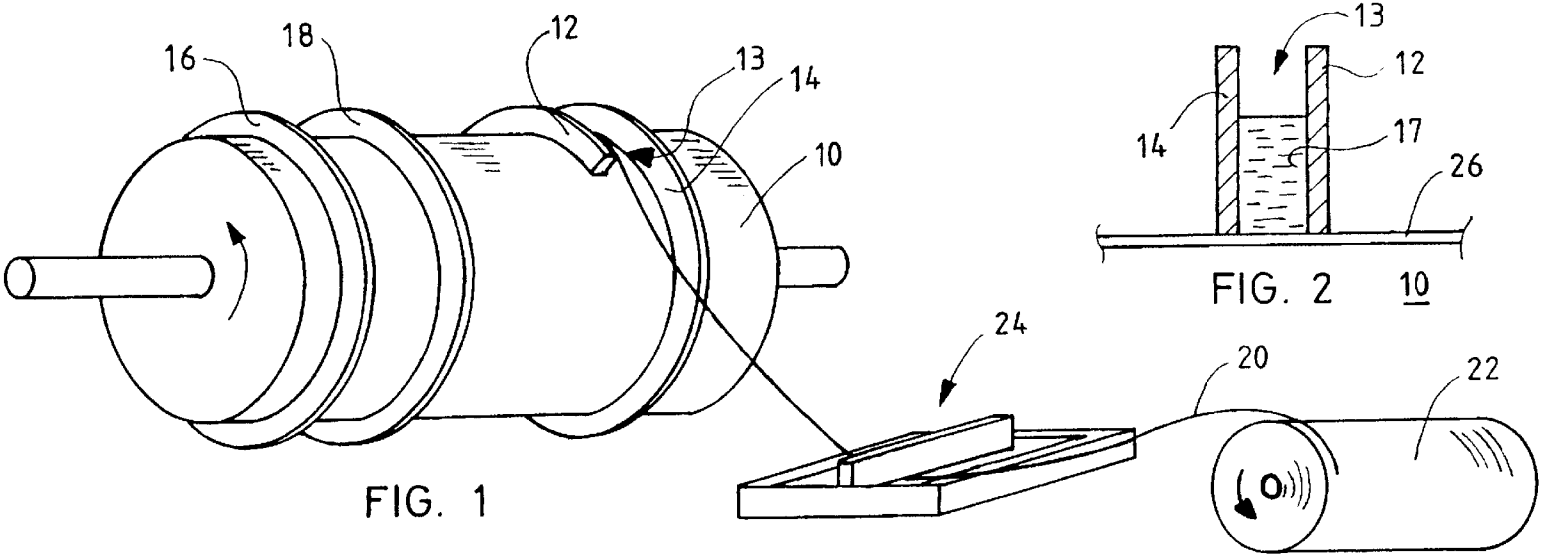
FIG. 1
FIG. 2
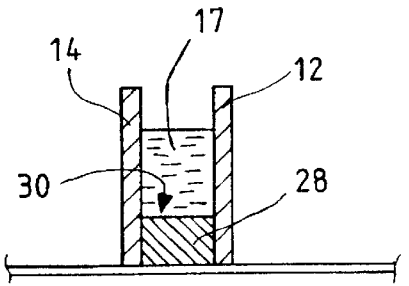
FIG. 3
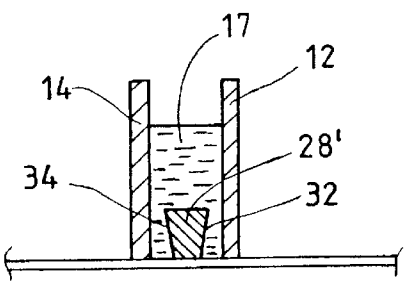
FIG. 4
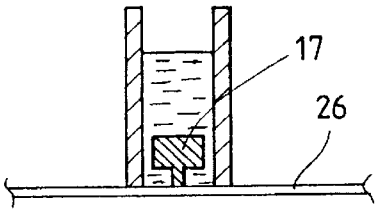
FIG. 5

SCREEN AND METHOD FOR MANUFACTURING A REINFORCEMENT ELEMENT FOR A SCREEN PLATE

This application is the U.S. national phase of International Application No. PCT/FI98/00796, filed Oct. 14, 1998, which designated the U.S.

The present invention relates to a screen defined in the appended independent claims and to a method of manufacturing a reinforcement for a screen plate.

The term "screen plate" in the description and claims means, unless otherwise stated, the screen plate of a drum screen, flat screen or the like. The screen plate according to the invention can be manufactured from a plate by machining or by forming in some other appropriate way screen apertures, such as circular screen holes or elongated screening slots therein. The plate can be provided with grooves, protrusions or the like in order to bring about a desired surface configuration.

The screen plate according to the invention can also be manufactured of screen wires by disposing them side by side so that the gaps between them form screening slots. The term "screen wire" here refers to elongated elements of various cross-sectional forms which, when positioned side by side, form screening slots between themselves.

The drum screens and the flat screens according to the invention are typically used in the pulp and paper industry for cleaning and fractionating fibre suspensions. They can, however, also be used in the food industry, for instance.

It is known technique to reinforce and stiffen screens, screen drums as well as flat screens, so that they will resist the forces and dynamic stresses they are subjected to during operation. The screen drums are most often reinforced by means of rings or bands attached to the surface of the drum. In drum screens of the "outflow" type, in which the suspension to be screened is introduced into the interior of the screen drum and the accepted fraction flows through the screen drum from the inside outwards, the reinforcing rings are mounted on the outside of the drum. In the drum screens of the "inflow" type, in which the accepted fraction flows in the opposite direction, the reinforcing rings are mounted on the inside of the screen drum.

Common to the reinforcements or the supporting elements of the prior art is that they are made of steel. Manufacturing of steel reinforcements comprises several production and mounting stages. In manufacturing, methods known per se, such as rolling, bending, sawing, turning, milling and grinding are used. In some stage of the production and mounting of the reinforcements and supporting members of steel welding generally has to be used in addition to other methods. Heat is then brought to the welding point, which may easily cause deformations and internal stresses in the screen plate and/or the reinforcement to be produced, which weakens the physical properties of the steel. The deformations can harmfully change the measures of the screening slots and the form and measures of the entire drum. In addition, the burrs that are produced as a result of the welding process cause a tendency to plug the screen as fibres stick on them. Welding is thus to be avoided.

These elements made of steel, when subjected to dynamic load, typically break down through crack growth. The internal stresses and the changes in the physical properties in the so-called heat-affecting zone (HAZ) caused by welding render the elements made of steel liable to crack growth.

SUMMARY OF THE INVENTION

It is an object of the present invention to provide an improved screen and an improved method of manufacturing a reinforcement for a screen plate, in which the above mentioned disadvantages are minimized.

It is more specifically an object of the invention to provide a durable and strong screen. The object is thereby to provide a screen drum having a reinforcement ring in which crack growth is avoided.

It is a further object of the invention to provide a method of manufacturing a reinforcement for a screen plate which is simple and which can be easily modified.

The object is thereby also to provide a method of manufacturing a reinforcement wherein the problems caused by high temperature are avoided.

A typical improved screen according to the invention for screening or fractionizing pulp suspensions or the like suspensions of the paper industry comprises a screen plate to the surface of which one or several reinforcements made of fibre-reinforced composite material are attached.

The arrangement according to the invention can be used in screen plates that are conventionally made of a sheet-like preform in which screen apertures are formed by machining or in some other appropriate way. The method according to the invention can also be used in screens in which the screen plate is made of screen wires disposed side by side in such a way that a screening slot is formed between adjacent screen wires.

The arrangement according to the invention can be used in screen plates, which are intended for use as screen drums in drum screens or as flat screen plates in flat screens. In drum screens, preferably annular or rib-like reinforcements are used. In flat screens, preferably reinforcing ribs or the like can be used. The reinforcement is preferably formed by the lamination of fibre rovings, which consist of thousands of fibres. The height of the reinforcing ring or rib is typically between about 5 to 100 mm, preferably 5 to 70 mm. The reinforcing rings can be attached to the screen drum for instance 20 to 100 mm apart from each other.

The reinforcement according to the invention is typically made by the lamination of layers of reinforcing fibres by a matrix material. Preferably, at least one fibre chosen from a group of fibre materials comprising carbon, glass, aramide, boron, aluminium or silicon oxide fibres, or some mixture of these, is used as the reinforcing fibre. The reinforcing fibre can of course consist of some other suitable fibre or the like.

The strength of the reinforcing fibres which are used is typically between 1000 and 5500 $N/mm^2$. Preferably a carbon fibre having a high modulus of elasticity and a strength of 3500 to 5500 $N/mm^2$ is used as the reinforcing material. The modulus of elasticity of the reinforcing fibres which are used has to be preferably >300 GPa. The reinforcement is preferably made of reinforcement fibre bands, also called rovings, consisting of thousands of reinforcing fibres or filaments or of band-like prepregs made of bands. The reinforcing fibres are positioned in the finished reinforcement substantially parallel with the surface of the screen plate.

As matrix material for connecting the reinforcing fibres, the material best suited for the reinforcing material in question is chosen. The matrix material should preferably have a good long-term strength in wet conditions, sufficient heat resistance at least at 100° C., good chemical resistance in a pH range of 2 to 14 and a good dynamic loading strength.

As matrix material preferably some thermoplastic or thermosetting resin is used. Suitable thermoplastic resins are for instance polypropylene, polyamide or acrylonitrile butadiene (ABS) and suitable thermosetting resins are for instance polyester, epoxy or phenolic resins.

The purpose of the matrix material, the resin or the plastic is to transmit the forces between the reinforcing fibres. In the laminate the matrix material prevents mainly the reinforcing fibres from moving in relation to each other. The matrix material has only a small influence on the tensile strength of the laminate in the direction of the fibres, whereas it is of importance as regards the load-carrying capacity of the shear forces between the layers. The purpose of the matrix material is to transmit the shear forces.

The present invention renders it possible to laminate reinforcing rings of rotationally symmetrical screens in one production stage only, in which the reinforcing fibre or the band or rovings made of it is wound between a pair of moulds/mould surfaces around the screen. When hardening, the composite formed of the reinforcing fibre and the matrix material wound between the pair of moulds forms the reinforcing ring. When the composite has hardened, the pair of moulds is removed. The desired height of the ring, i.e. its radial measure, is obtained by winding a desired amount of fibres or a desired amount of layers of bands of reinforcing fibre around the screen. The height of the reinforcing ring is usually about 5 to 50 mm.

The reinforcing ring of the composite material according to the invention can also be made in such a way that it is attached on top of a metal supporting ring or band mounted on the periphery of the screen drum. For the duration of the lamination, a ring forming one half of the pair of moulds is thereby positioned on the screen plate on each side of the above mentioned metal supporting ring. The rings forming the pair of moulds are usually radially higher than the supporting ring, and a space equal to at least the axial width of the supporting ring is left between them. In this way the entire supporting ring can be laminated into a reinforcement formed of composite material. The composite material is fed to this space for instance by winding several layers of bands or rovings of composite material around the screen drum on the supporting ring, i.e. in the space between the walls of the mould. So many turns of band or roving is wound around the screen drum that a reinforcement of desired height is obtained. The walls of the mould and the portion of the screen plate or of the supporting ring on the screen plate or of some other element forming the bottom of the mould determine the form of the reinforcement that is produced. The width of the bottom of the mould, i.e. the distance between the walls from each other, can be larger than the width of the supporting ring or the like on the surface of the screen plate. The bottom of the mould is thereby formed partly by the supporting ring and partly by the surface of the screen plate, and the width of the reinforcement that is produced will be larger than the width of the supporting ring.

The reinforcement, the reinforcing ring or band, can be attached to the surface of the screen plate or to the supporting ring mounted thereon by gluing it with the matrix material. The reinforcement can, on the other hand, be attached to the surface of the screen plate by using the geometry of the screen surface, supporting ring, or the like. The reinforcement can thus be attached to the screen surface for instance by using the hooking effect or the reverse relief. The reverse relief means a 'negative' relief, in other words, that the part is e.g. wedge-shaped in such a way that it is broader at the bottom of the mould than at the mouth. If the reinforcement is produced in a mould or a pair of moulds in which the walls are disposed on both sides of the supporting ring, and in which the distance between the walls is larger than the width of the supporting ring, a reverse relief and a mechanical attachment of the reinforcement to the surface of the screen plate can be brought about by choosing a supporting ring of an appropriate shape. A soft fibre-reinforced composite material can be made to flow tightly around the supporting ring when the reinforcement is produced. When hardened the composite material will be fixed to the supporting ring.

The reinforcement according to the invention can, on the other hand, be attached to other elements on the surface of the screen plate, such as a grooved supporting ring for the screen wires of the wire screen disclosed in the International Publication PCT/FI96/00520. The reinforcing fibre material is thereby wound around the screen drum inside the groove of the supporting ring using the groove in the supporting ring as a mould. Annular extensions of the walls of the groove can additionally be disposed on both sides of the supporting ring, which extensions enlarge the radial height of the mould used to produce the reinforcement and if desired also its width. The protrusions or the like in the groove of the supporting ring form fastening members to which the soft reinforcement can be attached.

The reinforcement according to the invention is preferably made of bands, rovings or other reinforcing fibre material dipped in a matrix liquid and which material can be wound in several layers around the periphery of the screen drum between the wall surfaces of the reinforcement mould disposed on the periphery of the screen drum, and then allowing it to harden chemically. The whole production process can be carried out at room temperature. Some systems require that the resin is cured and hardened at an elevated temperature, typically at a temperature of 80 to 200° C.

The reinforcement can, on the other hand, advantageously be made of bands, rovings or the like reinforcing fibre material containing solid matrix material, in which the matrix material is twined, for instance, into the reinforcing fibre. Also this band, roving or the like can be wound between the surfaces forming a reinforcement mould disposed on the periphery of a screen drum several runs around the periphery of the screen drum. The solid matrix material is softened/melted by heating it, for instance, in the winding stage preferably to a temperature of about 100–300° C. Thus, the matrix material is preferably melted just before the mould. The fibre-reinforced material is finally allowed to solidify in the reinforcement mould.

The temperature of the screen does not rise significantly in production methods described above, so that the adverse effects of high temperature are avoided by the method according to the invention.

BRIEF DESCRIPTION OF THE DRAWINGS

The invention will be described in more detail with reference to the accompanying drawings, in which FIG. 1 shows a schematic side view of the manufacturing stage of the middle reinforcement of a screen drum;

FIG. 2 shows a schematic cross-sectional view of a small portion of the surface of the screen plate and the pair of moulds mounted on the screen surface and the reeinforcement formed between the surfaces of the pair of moulds;

FIGS. 3–5 show schematic cross-sectional views according to FIG. 2 of the pair of moulds and reinforcement disposed around the supporting ring;

DETAILED DESCRIPTION OF PREFERRED EMBODIMENTS

Figure 7:
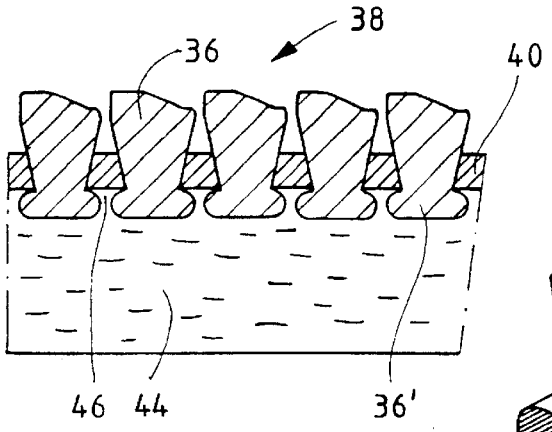
FIG. 7 shows a schematic cross-sectional view taken across the screen wires of the wire screen according to FIG. 6.

FIG. 1 shows the manufacturing of a reinforcement for a screen drum 10, wherein a third reinforcing ring is formed on the periphery of the screen drum 10 of a drum screen by means of mould surfaces 12, 14 of a pair of moulds. Two reinforcing rings 16, 18 have already been made and the mould surfaces around them have been removed.

The reinforcement is made by unwinding a dry band or roving 20 of reinforcing fibre from a reel 22 and leading it as a continuous band through a resin vat 24 to the periphery of the screen drum 10 between the mould surfaces 12, 14. The foremost mould surface 12 of the figure, i.e. the portion nearest to the spectator, is partly removed for the sake of clarity. In the resin vat 24 the reinforcing fibre band 20 is impregnated with a sufficient amount of matrix material i.e. resin for laminating the layers of reinforcing fibre band so as to bring about a strong reinforcement.

The reinforcing fibre band 20 is led to the space 13 between the mould surfaces 12, 14 while turning the screen drum in the direction shown by the arrow. The screen drum 10 can be turned several turns in order to bring about a reinforcement of desired thickness, i.e. of desired radial height, between the mould surfaces. The reinforcing band is wound between the pair of moulds not only one on the other but also if needed next to each other, spirally or crosswise in order to bring about a reinforcement of desired shape.

FIG. 2 shows a cross section of a portion of the screen surface 26 of the screen drum 10 and of the mould surfaces 12, 14 disposed on this surface. A reinforcement 17 is formed of several layers of reinforcing fibre band in the space 13 between the surfaces 12, 14, in which the reinforcing fibres are orientated parallel to the periphery of the screen drum.

FIG. 3 shows a cross section of the mould surfaces 12, 14 and a reinforcement 17 similar to FIG. 2, except that in this case the mould surfaces 12, 14 are disposed on both sides of a supporting ring 28 so that the outermost surface 30 of the supporting ring forms a bottom to which the reinforcement 17 is attached by laminating.

FIG. 4 shows an arrangement similar to that of FIG. 3, in which the mould surfaces 12, 14 are disposed on both sides of a supporting ring 28'. The supporting ring 28' is, however, in this case narrower than the distance between the mould surfaces, whereby a soft portion of the reinforcing fibre band penetrates into the space between the mould surfaces 12, 14 and the inclined side surfaces 32, 34 of the supporting ring 17. The side surfaces come nearer to the side surfaces of the mould in a direction outwards from the screen plate, wherefore the fibre-reinforced composite will be firmly fixed to the supporting ring when the composite hardens.

The arrangement shown in FIG. 5 is similar to FIG. 4 with the exception of the shape of the supporting ring 17. The side surfaces of the supporting ring in FIG. 5 are not inclined. The cross section of the supporting ring is T-shaped. The claws of the supporting ring protrude into the reinforcement forming members locking the reinforcement firmly to the screen plate 26.

In the case of FIGS. 4 and 5, the supporting ring is, compared to conventional attachments of reinforcing or supporting rings of metal, only attached to the surface of the screen plate along a small area. For that reason, the supporting rings of FIGS. 4 and 5 can be easily welded to the screen plate and with only slight heating of the screen plate. In some cases it is even possible to attach the supporting rings to the screen plate without any welding. When the reinforcement hardens, the reinforcement as well as the supporting ring will be firmly fixed to the periphery of the screen drum.

Figure 6:
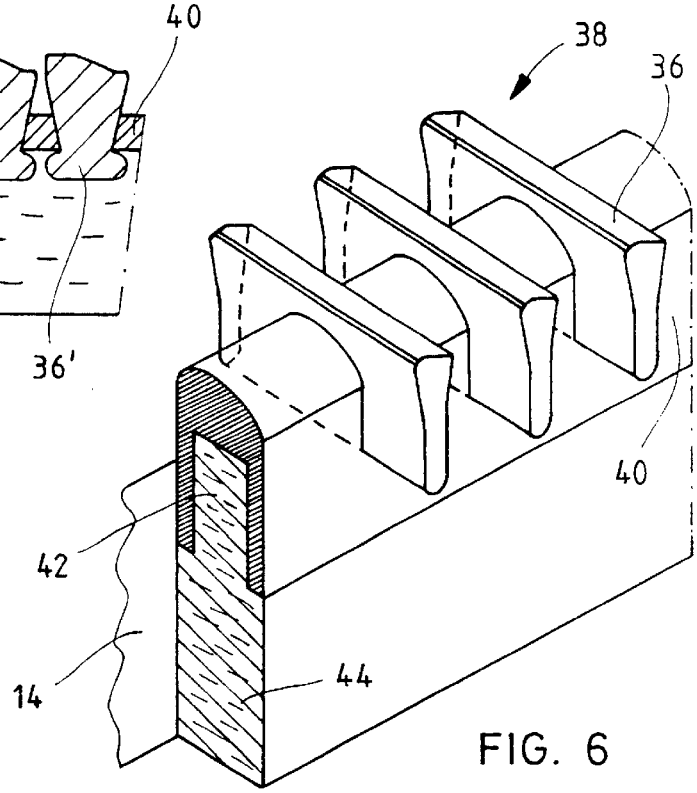
FIG. 6 shows a schematic view seen obliquely from above of a portion of a screen surface of a wire screen and the reinforcement produced on this wire screen.
Figure 8A:
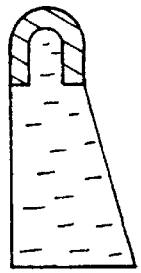
FIG. 8 shows cross-sectional views of various alternatives of the reinforcement for the wire screen according to FIG. 6.
Figure 8B:
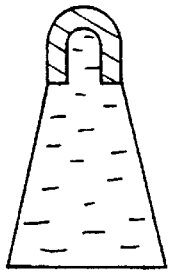
Figure 8C:
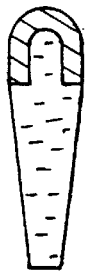
Figure 8D:
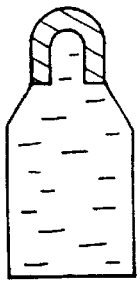
Figure 8E:
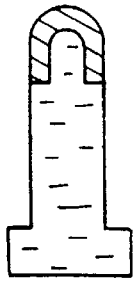
Figure 8F:
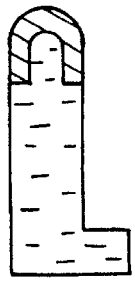

FIG. 6 shows a portion of a screen surface 38 formed of screen wires 36. The screen wires 36 are attached to a supporting ring 40, in which a groove 42 parallel with the periphery of the ring is made in the part directed away from the screen wires. In so called outflow-screens this groove 42 opens outwards, i.e. towards the periphery of the screen drum.

In the screen surface of FIG. 6 a fibre-reinforced reinforcement 44 according to the invention is produced by first turning a band of reinforcing fibre around the periphery of the screen drum inside the groove 42 of the supporting ring until the groove is full. After that layers of reinforcing fibre band are formed on top of the previous layers using extensions of the walls of the groove 42 as mould surfaces of which only the back mould surface 14 is shown in FIG. 6. In this way reinforcement of desired height is obtained.

FIG. 7 shows a cross section of the screen surface 38 of a wire screen of the type shown in FIG. 6, in which the parts 36' of the screen wires 36 protruding into the groove are deformed so as to lock them into the supporting ring 40. The reinforcing fibres that form the reinforcement 44 protrude into the space between the deformed parts 36' of the screen wires and the bottom 46 of the groove and will when hardening fix the reinforcement firmly to the supporting ring.

The form of the reinforcement is determined by the shapes of the groove in the supporting ring and the side surfaces 14 of the mould. FIG. 8 shows various shapes of reinforcements. In the alternatives a, b, d, e and f the reinforcement widens in the direction away from the supporting ring, which in many applications is preferable. In the alternative c, the reinforcement narrows in the direction away which, considering flow conditions, for instance, can sometimes be advantageous.

The advantages of the arrangement according to the invention are for instance:

- the following useful properties of the fibre-reinforced composite material compared with steel, that is
  - light weight; the weight of a reinforcement made of composite material can be only 1/7 of the weight of a reinforcement of the same size made of steel; high strength and specific stiffness due to the high modulus of elasticity, high dynamic strength and good corrosion resistance as the carbon fibre is totally non-reactive in the conditions in question and most resins and plastics are in this respect good.
- the invention renders it possible to produce the reinforcement in one stage by winding and laminating reinforcing fibre around the screen drum,
- the use of detrimentally high temperature is avoided,
- the problems associated with crack growth typically occurring in screens made of steel and which can cause breaking of the rings can be avoided, and
- the invention renders it possible to produce a reinforcement of desired height, width and shape in a simple way.

The invention is not limited to the embodiments described above, but, on contrary, can be applied in many ways within the scope of the claims described below.

What is claimed is:

1. A drum screen, for screening or fractionating pulp suspensions of the pulp and paper industry, the screen comprising:

a screen plate made of screen wires, which are disposed side by side in such a way that a screening slot is formed between adjacent screen wires, said screen plate forming a surface of said drum screen, and a reinforcement attached to said drum screen, said reinforcement being made of fibre-reinforced composite material wound several turns between two annular wall surfaces of a reinforcement mould disposed on a periphery of the drum screen, wherein said reinforcement comprises a 5 to 70 mm layer of reinforcing fibres laminated by a matrix material.

2. The drum screen according to claim 1, wherein the reinforcement comprises as the reinforcing fibre at least one fibre chosen from a group of fibre materials comprising carbon, glass, aramide, boron, aluminium or silicon oxide fibres or a mixture of these fibres.

3. The drum screen according to claim 1, wherein the reinforcement is made of a plastic composite comprising thermoplastic or thermosetting resin materials.

4. The drum screen according to claim 3, wherein the reinforcement is made of reinforcing fibre and of matrix material connecting the fibres, which matrix material comprises:

at least one of the following thermoplastic resins: polypropylene, polyamide or acrylonitrile butadiene (ABS), or at least one of the following thermosetting resins: polyester, epoxy or phenolic resins.

5. The drum screen according to claim 4, wherein the matrix material is an epoxy resin.

6. The drum screen according to claim 5, wherein the reinforcement comprises a reinforcing ring made by laminating reinforcing fibres and composite material around the screen drum.

7. The drum screen according to claim 5, wherein the reinforcing ring is attached on top of a supporting ring mounted on the periphery of the screen drum.

8. The drum screen according to claim 5, wherein the reinforcing ring is attached to the sides of a supporting ring mounted on the periphery of the screen drum or to a groove made in the supporting ring parallel with the periphery.

9. The drum screen according to claim 1, wherein the reinforcement is made of reinforcing fibre having a modulus of elasticity >300 GPa, and wherein the reinforcing fibres forming the reinforcement are substantially parallel with the surface of the screen plate.

10. A drum screen for screening or fractionating pulp suspensions of the pulp and paper industry, the screen comprising:

a screen plate made of screen wires which are disposed side by side in such a way that a screening slot is formed between adjacent screen wires, said screen plate forming a surface of said drum screen, and a plurality of reinforcements attached to said drum screen, said reinforcements each being made of fibre-reinforced composite material wound several turns between two annular wall surfaces of a reinforcement mould disposed on a periphery of the drum screen, wherein said reinforcements are disposed on the screen plate about 20 to 100 mm apart from each other.

11. A method of manufacturing a reinforcement for a screen plate of a drum screen for screening or fractionating pulp suspensions of the pulp and paper industry, the method comprising:

forming a screen plate of screen wires which are disposed side by side in such a way that a screening slot is formed between adjacent screen wires, attaching an elongated reinforcement in the form of a stiffening ring to the screen plate, said screen plate forming a surface of said drum screen, said reinforcement being made by laminating fibre-reinforced composite material, which is wound several turns between two annular wall surfaces of a reinforcement mould disposed on a periphery of the drum screen, said reinforcement being made of reinforcing fibre material dipped in a liquid matrix material, which reinforcing fibre material is fed to form a layer of desired thickness between the wall surfaces defining a reinforcement mould disposed on the screen plate, said reinforcing fibre material being allowed to harden in the reinforcement mould, wherein the reinforcement is made of a band or roving of reinforcing fibre material which is led through a bath of matrix material to the reinforcement mould.

12. The method according to claim 11, wherein:

the reinforcement is made of a band or roving of reinforcing fibre material containing solid matrix material, from which the reinforcement is formed at a desired point by means of the reinforcement mould positioned at this desired point, the band or roving of reinforcing fibre material is heated immediately before the reinforcement mould, to a temperature of 100 to 300° C. so as to melt the matrix material, and the reinforcing fibre material is allowed to harden in the reinforcement mould.

13. The method according to claim 11, wherein the reinforcement is attached to the screen plate by gluing with the matrix material.

14. The method according to claim 11, wherein the reinforcement is attached to the screen plate by using locking protrusions or cavities in the reinforcement.

15. The method according to claim 11, wherein the reinforcement is made of reinforcing fibre comprising at least one reinforcing fibre chosen from a group of fibre materials comprising carbon, glass, aramide, boron, aluminium or silicon oxide fibres or a mixture of these fibres.

16. The method according to claim 11, wherein the reinforcement is made of plastic composite comprising thermoplastic or thermosetting resin material.

17. The method according to claim 16, wherein the reinforcement is made of reinforcing fibre and matrix material connecting the fibres, which matrix material comprises:

at least one of the following thermoplastic resins: polypropylene, polyamide or acrylonitrile butadiene (ABS), or at least one of the following thermosetting resins: polyester, epoxy or phenolic resins.

18. The method according to claim 11, wherein the reinforcement is made of reinforcing fibre having a modulus of elasticity >300 GPa, and wherein the reinforcing fibres are caused to orientate parallel with the screen plate.

19. The method according to claim 11, wherein the reinforcement is made substantially at room temperature of reinforcing fibre material dipped in liquid matrix material, which reinforcing fibre material is allowed to harden substantially at room temperature in the reinforcement mould.

20. A method of manufacturing a reinforcement for a screen plate of a drum screen for screening or fractionating pulp suspensions of the pulp and paper industry, the screen plate comprising a screen plate made of screen wires, which are disposed side by side in such a way that a screening slot is formed between adjacent screen wires, wherein said screen wires are fastened to a supporting ring, said method comprising:

feeding reinforcing fibre material to form a layer of desired thickness by winding the reinforcing fibre material several turns between two annular wall surfaces of a reinforcement mould disposed on a periphery of the drum screen, attaching an elongated reinforcement in the form of a stiffening ring to the screen plate by laminating fibre-reinforced composite material between said wall surfaces, and allowing said reinforcing fibre material to harden in the reinforcement mould, wherein the reinforcement is made of a band or roving of reinforcing fibre material, and wherein said annular wall surfaces of said mould are at least partially formed of walls of the supporting ring.

21. The method according to claim 20, wherein said reinforcement is made of a band or roving of reinforcing fibre material which is led through a bath of matrix material to the reinforcement mould.

22. The method according to claim 20, wherein:

the reinforcement is made of a band or roving of reinforcing fibre material containing solid matrix material, from which the reinforcement is formed at a desired point by means of the reinforcement mould positioned at this desired point, the band or roving of reinforcing fibre material is heated immediately before the reinforcement mould, to a temperature of 100 to 300° C. so as to melt the matrix material, and the reinforcing fibre material is allowed to harden in the reinforcement mould.

23. The method according to claim 20, wherein the reinforcement is attached to the screen plate by gluing with the matrix material.

24. The method according to claim 20, wherein the reinforcement is attached to the screen plate by using locking protrusions or cavities in the reinforcement.

25. The method according to claim 20, wherein the reinforcement is made of reinforcing fibre comprising at least one reinforcing fibre chosen from a group of fibre materials comprising carbon, glass, aramide, boron, aluminium or silicon oxide fibres or a mixture of these fibres.

26. The method according to claim 20, wherein the reinforcement is made of plastic composite comprising thermoplastic or thermosetting resin material.

27. The method according to claim 20, wherein the reinforcement is made of reinforcing fibre and matrix material connecting the fibres, which matrix material comprises:

at least one of the following thermoplastic resins: polypropylene, polyamide or acrylonitrile butadiene (ABS), or at least one of the following thermosetting resins: polyester, epoxy or phenolic resins.

28. The method according to claim 20, wherein the reinforcement is made of reinforcing fibre having a modulus of elasticity >300 GPa, and wherein the reinforcing fibres are caused to orientate parallel with the screen plate.

* * * * *